United States Patent [19]

Weinberg et al.

[11] Patent Number: 4,950,368

[45] Date of Patent: Aug. 21, 1990

[54] METHOD FOR PAIRED ELECTROCHEMICAL SYNTHESIS WITH SIMULTANEOUS PRODUCTION OF ETHYLENE GLYCOL

[75] Inventors: Norman L. Weinberg, East Amherst; John D. Genders, Lancaster; Duane J. Mazur, Amherst, all of N.Y.

[73] Assignees: The Electrosynthesis Co., Inc., Amherst; SKA Associates, Buffalo, both of N.Y. ; a part interest

[21] Appl. No.: 335,894

[22] Filed: Apr. 10, 1989

[51] Int. Cl.[5] ..... C25C 3/00

[52] U.S. Cl. ..... 204/72; 204/77; 204/78; 204/79

[58] Field of Search ..... 204/59 R, 78, 79, 77, 204/72

[56] References Cited

U.S. PATENT DOCUMENTS

| | | | |
|---|---|---|---|
| 3,714,003 | 1/1973 | Engelbrecht et al. | 204/78 |
| 3,953,305 | 4/1976 | Connolly | 204/78 |
| 4,270,992 | 6/1981 | Saito | 204/59 R |
| 4,375,394 | 3/1983 | Devon | 204/78 |
| 4,478,694 | 10/1984 | Weinberg | 204/77 |
| 4,517,062 | 5/1985 | Barber | 204/77 |
| 4,582,942 | 4/1986 | Comninellis et al. | 204/59 R |
| 4,639,298 | 1/1987 | Kreh et al. | 204/59 R |
| 4,647,349 | 3/1987 | Kreh et al. | 204/59 R |
| 4,670,108 | 6/1987 | Kreh et al. | 204/59 R |
| 4,692,227 | 9/1987 | Spotnitz et al. | 204/78 |
| 4,701,245 | 10/1987 | Kreh | 204/78 |
| 4,732,655 | 3/1988 | Morduchowitz et al. | 204/59 R |
| 4,759,833 | 7/1988 | Lentz et al. | 204/59 R |

OTHER PUBLICATIONS

Kreh, Robert P. et al., Tetrahedron Letters, vol. 28, no. 10 pp. 1067–1068, 1987.

*Primary Examiner*—John F. Niebling
*Assistant Examiner*—Steven P. Marquis
*Attorney, Agent, or Firm*—Howard M. Ellis

[57] ABSTRACT

Paired electrochemical synthesis reactions in which ethylene glycol is formed at the cathode of a membrane divided cell at high concentrations and current efficiencies, up to 99 percent. Simultaneously, a compatible process is also conducted at the anode of the same electrochemical cell by reacting indirectly generated anode products with organic substrates to form secondary products, such as polybasic acids. The process is especially advantageous in that such secondary products, where appropriate can be further reacted with the ethylene glycol prepared from the catholyte of the same cell to form useful tertiary products, especially polyesters like polyethylene terephthalate. Mole ratios of ethylene glycol and polybasic acid can be controlled through selective use of regeneratable redox reactant.

30 Claims, No Drawings

METHOD FOR PAIRED ELECTROCHEMICAL SYNTHESIS WITH SIMULTANEOUS PRODUCTION OF ETHYLENE GLYCOL

BACKGROUND OF THE INVENTION

The present invention relates generally to methods of conducting paired synthesis reactions electrochemically, and more specifically, to the preparation of ethylene glycol at the cathode of an electrochemical cell while simultaneously producing a regeneratable redox reagent at the anode of the same cell, which redox reagent can be reacted with an organic substrate to prepare a secondary product indirectly.

Ethylene glycol is a major industrial chemical with worldwide production of about 20 billion pounds per year. Ethylene glycol is widely used in manufacturing polyester films and fibers and as an automotive coolant and antifreeze. The major source of ethylene glycol is from epoxidation of ethylene which is derived from petroleum, followed by hydration to form the glycol. However, dwindling petroleum reserves and petroleum feedstocks coupled with escalating prices has led to development of alternative routes based on syngas. Representative processes are described in U.S. Pat. Nos. 3,952,039 and 3,957,857. In a recent patent to N. L. Weinberg, U.S. Pat. No. 4,478,694, an electrochemical route is described wherein formaldehyde is electrohydrodimerized at the cathode to produce ethylene glycol at high current efficiencies and yields according to the equation:

$$2CH_2O+2H^{+}+2e^{-}\rightarrow HOCH_2CH_2OH \qquad (I)$$

Heretofore, many electrochemical methods of manufacturing organics, including synthesis of ethylene glycol were not widely accepted mainly because they were generally viewed as being economically unattractive. Significant effort has been made to improve the economics for the electrochemical synthesis of ethylene glycol. One such example is found in U.S. Pat. No. 4,478,694 which includes conducting the reaction while also performing a "useful anode process." The expression "useful anode process" was coined to denote reactions occurring at the anode for lowering power consumption or forming in-situ a product which can be utilized in the synthesis of ethylene glycol. Specifically, U.S. Pat. No. 4,478,694 discloses the oxidation of hydrogen gas at the anode for purposes of forming protons used in formaldehyde electrohydrodimerization at the cathode according to equation (I) above. U.S. Pat. No. 4,478,694 also discloses as a useful anode process the anodic oxidation of methanol to formaldehyde which in-turn is used as a catholyte feedstock in the electroreduction reaction.

U.S. Pat. No. 4,478,694, however, fails to disclose electrochemical synthesis reactions in which secondary products formed at the anode are not used in the synthesis of ethylene glycol at the cathode. That is, the U.S. patent does not teach or suggest the preparation of secondary products formed by reacting "indirectly", generated anode products with ethylene glycol synthesized at the cathode to produce a third product, e.g. dimers, trimers, tetramers or other polymers. Terms like "indirect" or "indirectly" referring to electrolysis product(s), as used herein are intended to mean organic products which are not formed directly at the anode by oxidation of an organic feed, but instead are produced by reaction of the organic feed with a regeneratable redox reagent, as a consequence of the latter's oxidation at the anode.

Accordingly, the present invention contemplates even more economically attractive electrochemical synthesis reactions with the simultaneous production of ethylene glycol wherein two or more useful products are generated simultaneously at the anode and cathode of the same electrochemical cell, and where the anode product(s) are formed indirectly, hereinafter referred to as "paired electrochemical synthesis". The process is specially significant in light of the paired products ability to share in capital costs for cells, as well as operating costs, and particularly power.

But, the process is also quite surprising in view of the fact that usually paired reactions cannot be conducted successfully side-by-side in the same electrochemical cell due to fundamental incompatibilities in cathodic and anodic reactions, e.g. operating conditions and cell components, to name but a few. More specifically, in the paired electrochemical synthesis of ethylene glycol at the cathode while simultaneously producing a regeneratable redox reagent at the anode for reaction with an organic substrate to form a secondary product indirectly, many of the more preferred metal ions of redox couples, such as $Ce^{+3}$ or $Ce^{+4}$; $Cr^{+3}$ and $Co^{+2}$ or $Co^{+3}$ could pass from the anolyte compartment through the membrane separator to the catholyte compartment in competition with protons which are required for the cathodic process in accordance with equation (I) above. In the absence of sufficient protons a pH imbalance occurs on the cathode side. This will depress the conversion efficiency of formaldehyde to ethylene glycol which translates into greater power consumption and costs per unit of product produced. In addition, passage of these metal ions of regeneratable redox reagents from the anode to the cathode side, has a tendency to inhibit the electroreduction of formaldehyde to ethylene glycol by "poisoning" the carbon cathode. Consequently, the hydrogen current efficiency increases and the desired ethylene glycol current efficiency of at least 70 percent decreases. Passage of metal redox reagent ions from the anolyte to the catholyte compartment also means losses of valuable redox metal salts, necessitating increased costs for their makeup, recovery and/or disposal.

In addition to the foregoing problems associated with paired electrochemical synthesis with simultaneous production of ethylene glycol, certain regeneratable redox reagents have a tendency to precipitate in membrane/separators leading to increased IR loses and membrane destruction. Membranes are also subject to destruction by oxidants formed in the anolyte. Moreover, back-transfer of catholyte species, particularly organics, such as formaldehyde, ethylene glycol and oxidizable electrolyte anions, such as formate, into the anolyte causes deactivation of oxidant species and current efficiency losses. Accordingly, the present invention provides for important technical improvements in the electrochemical production of ethylene glycol making this method even more economic through a paired reaction format.

SUMMARY OF THE INVENTION

It is a principal object of the invention to provide a method of conducting a paired electrochemical synthesis reaction by the steps of:

(a) in a membrane divided electrochemical cell comprising an anode in an anolyte compartment and a cathode in a catholyte compartment, reducing electrochemically a formaldehyde containing catholyte to form ethylene glycol;

(b) providing a regeneratable redox reagent containing anolyte having higher and lower valence state ions;

(c) electrochemically oxidizing the lower valence state ions of the regeneratable redox reagent at the anode to the higher valence oxidizing state while simultaneously forming ethylene glycol at the cathode of the same electrochemical cell without trade-offs in ethylene glycol current efficiency i.e. of at least 70 percent;

(d) chemically reacting the anolyte comprising the higher valence state ions of the regeneratable redox reagent with an oxidizable organic substrate to produce an organic compound and spent redox reagent, and (e) anodically regenerating the spent redox reagent.

It is a further principal object of the invention for conducting the methods in electrochemical cells specially equipped with membranes, such as stable cation exchange types, stable anion exchange types, stable bipolar membranes, including multi-compartment cells, particularly three compartment electrochemical cells.

It is yet a further object to conduct the methods of the invention by the steps of modifying electrolytes through incorporation of additives, e.g. sufficient strong acid to inhibit passage of regeneratable redox reagents from the anolyte to the catholyte compartments, including recycling of oxidation stable acids and the addition of metal ion complexing agents to the catholyte.

It is still a further object of the invention to provide for methods of conducting paired electrochemical reactions in which a formaldehyde-containing catholyte is reduced to ethylene glycol while higher valence state oxidizing ions of a regeneratable redox reagent from the anolyte are reacted indirectly with oxidizable aromatic compounds to form secondary products, and particularly compounds which are oxidizable to polybasic acids, such as terephthalic acid. This includes methods for preparation of useful tertiary products like polyesters in reactions, according to the steps of:

(a) reducing in a membrane divided electrochemical cell a formaldehyde-containing catholyte to form ethylene glycol;

(b) oxidizing simultaneously in the same electrochemical cell a regeneratable redox reagent-containing anolyte to form ions having a higher valence oxidizing state;

(c) indirectly reacting the higher valence state ions of the regeneratable redox reagent in a reaction zone outside the electrochemical cell with an organic compound to form a secondary product, like a polybasic acid;

(d) separating spent regeneratable redox reagent from the secondary product, e.g. polybasic acid and anodically regenerating the spent reagent, and (e) condensing the ethylene glycol produced in the catholyte with the polybasic acid to form polyesters, like polyethylene terephthalate or polyethylene isophthalate.

The present invention also contemplates paired electrochemical synthesis reactions in which ethylene glycol is prepared and other products, such as aldehydes, quinones, glycol esters, ethers, dioxolanes, and the like, are indirectly prepared at the anode.

DETAILED DESCRIPTION OF THE INVENTION

In accordance with the invention there is provided paired electrochemical synthesis reactions in which ethylene glycol is formed at the cathode of a membrane divided cell at high yields and at current efficiencies of at least 70 percent, and more preferably, 80 to 95 percent or greater, i.e. 99 percent, by the electroreduction of formaldehyde-containing electrolytes. A process made compatible through this invention takes place simultaneously at the anode by reacting indirectly, anodically generated oxidizing products with an organic substrate to form secondary products. For purposes of this invention the expression "secondary product" is intended to mean any organic substance formed indirectly by reaction with oxidant produced at the anode which is not used in the synthesis of ethylene glycol at the cathode, and where appropriate can be reacted with the ethylene glycol prepared at the cathode to form useful tertiary products. Thus, one principal aspect of the invention relates to an electrochemical process in which ethylene glycol is synthesized at the cathode while a second reaction is also taking place at the anode, but significantly without consequential trade-offs in the ethylene glycol current efficiency at the cathode and without substantial losses of redox ions from the anolyte compartment, proton imbalance, etc. That is, by oxidizing at the anode concurrently, the lower valence state ions of a regeneratable redox reagent to their higher valence oxidizing state and chemically reacting indirectly with an organic substrate, e.g. an oxidizable aromatic compound, such as p-xylene, m-xylene, p-toluic acid, benzene, naphthalene, anthracene, p-methoxytoluene, etc., useful secondary products can be prepared, like terephthalic acid, isophthalic acid, aldehydes, quinones, etc. Such useful secondary products can be marketed as is through ordinary channels of commerce, but more preferably, polybasic acids are condensed with the ethylene glycol produced from the catholyte to prepare important tertiary products, like polyesters as part of the same process. Accordingly, the paired electrochemical synthesis processes of the present invention contemplate both electrochemical and chemical steps in the preparation of valuable secondary products as well as tertiary products formed when reacted with ethylene glycol made from the catholyte.

In carrying out the objectives of this invention an electrochemical cell is provided with a suitable cathode, an anode and at least one ion-exchange membrane per unit cell to separate aqueous anolyte and catholyte solutions. The cathode may be comprised of a carbonaceous material, such as graphite or graphite/polymer composite or other appropriate material, while the choice of anode is based on selectivity in the regeneration of spent, regeneratable redox reagent, adequate electrical conductivity, and chemical, electro-chemical and mechanical stability to the anolyte and process conditions. Specifically, for conducting the reaction with anolytes which are acid or near neutral the anode material may be comprised of graphite, carbon felt, vitreous carbon, specifically fluorinated carbons (SFC TM brand carbons available from The Electrosynthesis Company, Inc., E. Amherst, N.Y.), platinum, gold, platinum on titanium, noble metal oxides on titanium, and $PbO_2$ on graphite, lead, titanium, niobium or Ebonex ® (ceramic $Ti_4O_7$ from Ebonex Technologies, Inc.).

Electrochemical reactions are carried out in aqueous catholyte and anolyte solutions having a pH ranging from about 3 to about 8, and at temperatures generally ranging from about 60° C. to about 110° C., and more preferably, from about 50° C. to about 90° C. Both the anolyte and catholyte preferably operate at about the same temperature. The catholyte comprises formaldehyde, supporting electrolyte salts, such as sodium formate, potassium acetate, sodium methanesulfonate, sodium chloride, etc., and if required, a quaternary ammonium salt, such as tetralkylammonium salts, e.g.tetramethyl-, tetraethyl- and tetrabutylammonium formates, acetates, methanesulfonates, chlorides, etc., all of which are utilized at concentrations consistent with operating at current efficiencies and yields of ethylene glycol, at reasonably high current densities and low cell voltages for economical production. The ethylene glycol process is conducted at a current efficiency of at least 70 percent, and more preferably, maintained at current efficiencies in the range of 75 to 99 percent. To maintain the current efficiency at a high level, stable miscible or immiscible organic cosolvents can be added to the aqueous catholyte. Representative examples include sulfolane, tetra-hydrofuran, cyclohexane, ethyl acetate, acetonitrile and adiponitrile. Alcohol cosolvents should be avoided, particularly at concentrations greater than 0.1 to 5 percent by weight because they generally inhibit glycol formation. Immiscible organic cosolvents of high extraction capability for ethylene glycol, like ethyl acetate and amyl acetate are especially useful in avoiding distillation of the aqueous electrolyte. Other cosolvents, such as sulfolane and adiponitrile are higher boiling and enable distillation of the glycol from the electrolyte-cosolvent mixture.

The aqueous anolyte comprises as a principle component at least one regeneratable redox reagent having higher and lower valence state metal ions. Representative examples include $Cr_2O_7^{-2}/Cr^{+3}$, $Ce^{+4}/Ce^{+3}$, $Co^{+3}/Co^{+2}$, $Ru^{+6}/Ru^{+4}$, $Mn^{+3}/Mn^{+2}$, $Fe^{+3}/Fe^{+2}$, $Pb^{+4}/Pb^{+2}$, $VO_2^{+}/VO^{+2}$, $Ag^{+2}/Ag^{+}$, $Tl^{+3}/Tl^{+}$ and mixtures thereof Preferred higher and lower valence state ions are $Cr_2O_7^{-2}/Cr^{+3}$, $Ce^{+4}/Ce^{+3}$, $Ru^{+6}/Ru^{+4}$ and $Co^{+3}/Co^{+2}$. For optimum efficient regeneration of the lower valence state ions of the regeneratable redox reagent to the higher valence oxidizing state and subsequent facile reaction with the organic substrate, either in the cell or preferably in a reaction zone outside the cell an oxidant regeneration catalyst may be added to the anolyte. This would include, for example, soluble salts of silver, copper and cobalt which increase the rates of electrochemical generation of the oxidant species and/or rates of reaction of oxidant with organic substrate.

The aqueous anolyte can also comprise stable organic cosolvents which can aid in solvating the aromatic organic substrates previously mentioned in synthesizing secondary products. The cosolvent may be miscible or immiscible with the aqueous phase, and depending largely on inertness to oxidation by the oxidant, may include such representative examples as sulfolane, ketones such as methyl ethyl ketone and dipropyl ketone, hydrocarbons like cyclohexane, nitriles like acetonitrile, propionitrile, adiponitrile and benzonitrile, ethers such as tetrahydrofuran and dioxane, organic carbonates such as propylene carbonate, esters like ethyl and propyl acetate, halocarbons like methylene chloride, chloroform, dichloroethane, trichloroethane and perfluorooctane. Optionally, anionic and cationic surfactants or phase transfer reagents, such as sodium dodecylbenzene sulfonate and tetrabutylammonium hydroxide, respectively, may be added to the anolyte for some degree of emulsification with insoluble organic substrates, thereby facilitating reaction of the higher valence oxidizing ion therewith.

In order to avoid cross-contamination of the anolyte and catholyte solutions ion-exchange membranes are a necessary component of the invention. Membranes perform as separators aiding in preventing losses of formaldehyde and ethylene glycol into the anolyte stream, and hence possible destruction of the formaldehyde and ethylene glycol, as well as the loss of valuable regeneratable redox reagent, both reduced and oxidized forms, into the catholyte where deleterious processes, such as cathode poisoning and membrane fouling can occur. Accordingly, membranes must be judiciously selected to be chemically, mechanically and thermally stable to these electrolytes while preventing the loss and destruction of reactant and product contained therein.

Membranes are also chosen on the basis of cost, lowest cell voltage contribution and for their ionic selectivity, and may be either anionic, cationic or bipolar. Stable cation exchange membranes are generally preferred, especially for highly oxidizing acidic anolyte solutions. Of particular importance are the more oxidation stable fluorinated and perfluorinated type membranes which have higher temperature stability and resist thermal degradation in the temperature region of operation. Such membranes are available from companies like Dupont under the registered trademark Nafion which are sulfonic acid type membranes; Raipore® quaternary ammonium ion and sulfonic acid type membranes available from RAI Research Corporation, Hauppage, N.Y. Others are available from Asahi Glass and Tosoh. Because of their stability the perfluoro-sulfonic acid type cation exchange membranes are especially preferred with more powerful oxidants over a wide pH range and at higher operating temperatures. They, like other cation exchange type membranes exclude negatively charged redox species e.g. $Cr_2O_7^{-2}$, $Fe(CN)_6^{-4}$, from crossing into the catholyte with consequent contamination of that solution.

Notwithstanding the generally favorable performance of these membranes, even with their judicious selection, they may still not be sufficient to overcome the separation problems associated with the paired electrochemical synthesis reactions with the simultaneous production of ethylene glycol according to the invention. In this regard, a principal problem associated with the use of cation exchange membranes is that they allow the positively charged metal ions of the regeneratable redox reagent in the anolyte compartment to pass through to the catholyte compartment in competition to the preferred process of proton transfer. While it was surprising to find that certain redox species like $Ce^{+4}$, $Ce^{+3}$ $Cr^{+3}$, $Co^{+2}$ or $Co^{+3}$ did not inhibit the synthesis of ethylene glycol to the extent of other metal ion contaminants e.g. calcium, iron, copper, by entering the catholyte compartment and poisoning the cathode process, it was nevertheless found that these positively charged redox species have a generally unacceptable tendency to pass from the anolyte to the catholyte compartment with cation exchange membranes in competition with protons which are required to produce ethylene glycol at the cathode according to Equation (I). Consequently, even with use of the preferred cation exchange membranes a pH imbalance occurs on the cathode side of the cell resulting in lower product output. With the use of such membranes costly losses of redox reagents in the catholyte stream can occur which means higher operating costs for recovery or replacement of these salts. In addition, redox ion buildup in the catholyte will eventually poison the cathode process.

Accordingly, it was discovered that the foregoing problem can be overcome by maintaining the proton concentration in the anolyte compartment at as high a value as possible compared to the concentration of positively charged regeneratable redox species such that the protons needed for conducting the cathode reaction transfer through the cation exchange membrane to the catholyte compartment in preference to these metal ions. To achieve this result the present invention contemplates the addition to the anolyte compartment of a "strong acid" as the source of protons, the acid being added in an amount which is sufficient to inhibit passage of the metal ion regeneratable redox reagent from the anolyte to the catholyte. For purposes of this invention the expression —strong acid— is intended to mean acids which when dissolved in water are virtually completely dissociated into ions (see Quantitive Chemical Analysis, 4th. Ed, Macmillan Co., 1969, page 38). Representative strong acids include sulfuric, phosphoric, nitric, perchloric, as well as methanesulfonic and trifluoromethanesulfonic acids. The pH of the anolyte having the strong acid solution is generally less than about 2, and more preferably less than a pH of 1. In the case of cerium ions and $Cr^{+3}$, for instance, the molar hydrogen ion concentration of strong acid in the anolyte compartment is greater than the total molar concentration of positively charged ions of the regeneratable redox reagent.

While chromium ion in its lower valence state, $Cr^{+3}$, is able to cross a cation exchange membrane into the catholyte compartment, the higher valence counterpart, $Cr^{+6}$ generally exists in the anolyte solutions of this invention as negatively charged dichromate ions ($Cr_2O_7^{-2}$), and hence, cannot pass through a membrane having negative polarity. Thus, it was also found that when the regeneratable redox reagent is $Cr_2O_7^{-2}/Cr^{+3}$ it is advantageous for the molar concentration of the $Cr_2O_7^{-2}$ ion in the anolyte to be at least equivalent to that of $Cr^{+3}$ ion, and more preferably, at least twice the molar concentration of the $Cr^{+3}$ ion. This is accomplished by limiting the percentage conversion of $Cr_2O_7^{-2}$ to $Cr^{+3}$ in its subsequent reactions with organic substrates.

While maintaining a high proton concentration in the anolyte relative to the positively charged redox species is an effective means for controlling losses of valuable metal ions to the catholyte stream with a cation exchange membrane, any losses in ethylene glycol current efficiency which might otherwise occur in the process gradually after a period of time can be further limited through use of metal ion complexing agents in the catholyte. This would include any of the well known complexing agents, such as ethylenediamine tetraacetic acid (EDTA) and nitrilotriacetic acid (NTA) to name but a few. Other means for recovering the metal ions from the catholyte would include precipitation, use of ion exchange resin beds, etc.

While anion exchange membranes would appear to be useful in the paired electrochemical synthesis process, particularly since both the positively charged and negatively charged redox ion species as well as protons are unable to readily transfer through the positively charged membrane from the anolyte to the catholyte compartment, anion exchange membranes like the preferred cation exchange type cannot be utilized in the paired process without experiencing significant operating problems. In this regard, anionic species present in the catholyte are able to transfer through the membrane to the anolyte. It was found that anions like formate, acetate and chloride used in the catholyte as supporting electrolytes in the electroreduction of formaldehyde are readily oxidized at the anode or by electrogenerated oxidant. Furthermore, the pH of the catholyte progressively becomes more alkaline as electrolysis proceeds requiring the continuous addition of acid. Similarly, the anolyte becomes more acidic because of protons generated in the anolyte stream as the oxidant is formed. The anion portion of the acid passes through the membrane from the catholyte to the anolyte compartment.

Accordingly, it was discovered that the foregoing problems associated with the use of anion exchange membranes can be overcome through use in the catholyte of the salt of an acid with an oxidation stable anion. Sufficient oxidation stable acid is added to the catholyte to maintain the pH of the catholyte in the range from about 5 to about 8. Representative examples of useful acids include those in which the anion of the acid is either sulfate, bisulfate, phosphate, methanesulfonate, trifluoromethanesulfonate, fluoride, tetrafluoroborate or hexafluorophosphate. The special advantage of employing an oxidation stable acid is that since the acid added to the catholyte and the anolyte will be the same e.g. methanesulfonic acid, the excess acid in the anolyte stream can be recovered continuously, for instance, by distillation or electrodialysis of a side stream of the anolyte. The recovered acid can then be recycled back to the catholyte compartment for purposes of maintaining the pH range optimal for the cathode compartment.

A further alternative to cation and anion exchange membranes previously described, are bipolar type membranes. Although less preferred because of higher capital costs and potentially higher operating costs due to greater IR drop, bipolar membranes nevertheless are advantageous because they have dual polarity, i.e. both anionic and cationic. They essentially "split" water allowing protons to transfer to the catholyte from the cationic side and hydroxide ions to transfer to the anolyte from the anionic side without permitting metal redox ion species from penetrating into the catholyte. Thus, stable bipolar membranes, and particularly fluorinated bipolar types, such as those manufactured by Tosoh are practical in solving the problems previously described in connection with selective transmission of ions in the paired electrochemical synthesis methods disclosed herein.

The electrochemical cells of the present invention are usually two compartment cells having anolyte and catholyte compartments. Such cells may be batch or continuous flow types, as well as monopolar and bipolar in design which may include plate and frame types, packed bed electrodes, fluidized bed electrodes, other high area three dimensional electrodes, as well as capillary gap and zero gap designs, etc., depending on the economics of the paired process in which the lowest capital and operating costs for the cells are sought.

Although such two compartment membrane divided cells are preferred, the problems previously described in connection with the transmission of various organic and ionic species between compartments of the cells can also be remedied by means of membrane divided three compartment type cells of known design. This alternative embodiment contemplates a central or buffer compartment situated between anolyte and catholyte compartments. The central compartment may be filled with an aqueous strong acid electrolyte and be bounded by two stable cation exchange membranes, two anion exchange membranes, or a cation and an anion exchange membrane, preferably fluorinated if the anion exchange membrane separates the anolyte and the central compartment electrolyte. Preferably, with a three compartment cell at least one membrane is a stable fluorinated anion exchange type. A three compartment electrochemical cell is desirable because it minimizes losses of regeneratable redox reagent ions into the catholyte compartment. Instead, in the case of two cation exchange membranes as an example, any redox metal ions passing through the membrane on the anolyte side of the cell accumulate in the acidic central compartment while protons from the anolyte compartment are able to preferentially pass to the catholyte compartment. Those metal ions in the central compartment may be continuously removed by methods generally known in the art, such as ion-exchange resins or electro-dialysis, and subsequently recovered for recycling back to the anolyte stream.

Secondary products are prepared by electrochemically oxidizing the lower valence state ions of the regeneratable redox reagent at the anode to the higher valence oxidizing state while simultaneously forming ethylene glycol at the cathode of the same electrochemical cell without trade-offs in current efficiencies, i.e. maintaining the ethylene glycol current efficiency of the paired electrochemical reaction at substantially the same level as the ethylene glycol current efficiency would otherwise be without the paired reaction taking place at the anode. The cathodic and anodic electrolysis may be performed at current densities ranging from about 10 mA/cm$^2$ to about 1 A/cm$^2$, and more preferably, from about 50 mA/cm$^2$ to about 500 mA/cm$^2$ Secondary products are prepared indirectly by chemically oxidizing, usually in a separate zone external to the cell. In this case, it is preferable to transfer the anolyte comprising the higher valence oxidizing ions to a separate reaction vessel where it is contacted with the organic substrate feed under agitation. The organic substrate may be introduced into the reaction vessel as a pure substrate, dissolved or dispersed in the aqueous phase of the anolyte, or dissolved in a cosolvent with the aqueous solution. The reaction products, spent oxidant and secondary product may be separated by precipitation of the product, or by phase-separation, extraction, electrolysis, distillation, etc. The most suitable process of separation will depend on the nature of the organic feed and the secondary product, which will be readily ascertainable by those skilled in the art. The solution comprising the spent oxidant, i.e. reduced or lower valence state ions, is then returned to the cell for regeneration.

Organic substrates suitable for producing secondary products by indirect electrolysis are many and varied. Generally, the higher valence state oxidizing ions of the regeneratable redox reagent from the anolyte are reacted with an oxidizable organic compound, and particularly oxidizable aromatic compounds. Representative examples include benzene, naphthalene and anthracene which are oxidized to their corresponding quinones. Other oxidizable aromatic compounds are p-xylene, p-toluic acid, p-hydroxymethyltoluene, p-hydroxymethylbenzaldehyde and 1,4-dihydroxymethylbenzene which with the more powerful oxidants like $Cr_2O_7^{-2}$ and $Ru^{+6}$ form terephthalic acid. Likewise, m-xylene can be oxidized to isophthalic acid. The process of the present invention is especially significant because such polybasic acids as terephthalic acid, isophthalic acid, trimesic acid and naphthalene-1,4-dicarboxylic acid can be conveniently condensed with ethylene glycol produced from the catholyte of the same electrochemical cell to form commercially important polyesters as polyethylene terephthalate (PET) and polyethylene isophthalate. Polybasic acids formed as secondary products according to this invention are intended to also include aliphatic acids of the formula:

$$HOOC\text{-}(CH_2)_n\text{-}COOH \qquad (II)$$

Polybasic aliphatic acids of Compound (II) include those where n is a number from 2 to 10.

Secondary products like trimesic acid can be formed by reacting indirectly the organic substrate mesitylene. Others include 1,4-dimethylnaphthalene to form napthalene-1,4-dicarboxylic acid and polyesters by condensing with ethylene glycol produced from the catholyte of the same electro-chemical cell; 1,8-octenediol to form the dialdehyde or diacid as well as polyesters when condensed with ethylene glycol. The paired electrochemical synthesis reactions may also be used for indirect oxidation of methyl substituted aromatics to form hydroxymethyl, aryl aldehyde or carboxylic acid derivatives, as for example, the conversion of p-methoxytoluene to p-methoxybenzyl alcohol, anisaldehyde or anisic acid; toluene to benzaldehyde and p-tert-butyltoluene to p-tert-butylbenzaldehyde. Similarly, alkyl substituted aromatics can be reacted to form arylalkyl ketones e.g. the conversion of ethylbenzene to acetophenone. Paired electrochemical synthesis also includes the reaction of starch to form dialdehyde starch. Olefins can also be indirectly reacted to form epoxides, for instance, ethylene, propylene, butylene and other oxides, as well as glycols, like ethylene and propylene glycol. In addition, epoxides may react with ethylene glycol to afford polymers. Olefins under other process conditions may provide ketones, such as the conversion of butene to 2-butanone.

A further embodiment of the invention includes the purification and reaction of ethylene glycol with a purified secondary product formed by the indirect oxidation of an organic substrate with an electrochemically regeneratable redox reagent. Thus, purified ethylene glycol may be condensed with purified, indirectly formed terephthalic acid to form, for example, PET fibers, films, etc. As previously indicated organic substrates like p-xylene, p-toluic acid, and the like, can be indirectly oxidized with $Cr^{+6}$ present as dichromate, $Ce^{+4}$, $Ce^{+4}/Cr_2O_7^{-2}$, as well as other species possessing the appropriate oxidizing potential. The oxidation of p-xylene (PX) to terephthalic acid (TA) by $Cr^{+6}$ requires $12e^-$ according to the reaction:

$$PX + 4H_2O \rightarrow TA + 12H^+ + 12e^- \qquad (III)$$

Thus, the overall theoretical production of the cell for ethylene glycol (EG) and TA follows by combining the reactions of (I) and (III):

$$PX + 12CH_2O + 4H_2O \xrightarrow{Cr^{+6}} 6EG + TA \qquad (IV)$$

or a mole ratio of EG to TA of 6:1 to provide a large excess of ethylene glycol relative to terephthalic acid. In contrast, $Ce^{+4}$ oxidation of methyl substituted benzenes tends to yield aldehydes. With oxidation of p-xylene using $Ce^{+4}$ an eight electron oxidation is required to provide phthaldehyde.

$$PX + 2H_2O \xrightarrow{Ce^{+4}} \text{phthaladehyde} + 8H^+ + 8e^- \quad (V)$$

With further catalytic air oxidation of phthaldehyde, TA can be prepared according to the equation:

$$\text{phthaldehyde} + O_2 \rightarrow TA \quad (VI)$$

By combining equations I, V and VI, the overall process using $Ce^{+4}$ followed by catalytic air oxidation is shown by equation VII:

$$PX + 8CH_2O + 2H_2O + O_2 \xrightarrow{Ce^{+4}} 4EG + TA \quad (VII)$$

Equation VII provides for a mole ratio of EG to TA of 1 for less excess production of ethylene glycol relative to terephthalic acid.

Likewise, catalytic air oxidation of other partially oxidized p-xylene derivatives, such as 1,4-dihydroxymethylbenzene, p-carboxybenzaldehyde or p-hydromethylbenzaldehyde, may be employed in the manner disclosed above.

The Amoco process for commercial air-catalyzed production of terephthalic acid from p-xylene and its subsequent purification, crystallization and condensation with ethylene glycol is described in *Industrial Organic Chemistry,* by Weissermel and Arpe, Verlag Chemie, 1978. High pressure (15–30 bar) reactors lined with titanium or Hasteloy C are used to carry out the air oxidation process at 190° to 205° C. The crude product, dissolved in water under pressure at 225°–275° C. is then hydrogenated over Pd/charcoal catalyst to convert undesired p-carboxybenzaldehyde to more readily manageable p-toluic acid, whereby the terephthalic acid crystallizes out of the aqueous solution on cooling. In contrast, the electrochemical route of the present invention advantageously requires no high pressure equipment, nor costly lined reactors for the oxidation stage.

Polyester production is accomplished commercially by condensing the polybasic acid, e.g. terephthalic acid and ethylene glycol at elevated temperatures and pressures, wherein the mole ratio of EG to TA is 1:1. Excess ethylene glycol in either case of chromium or cerium oxidation can be marketed for antifreeze and other applications.

Other ethylene glycol/indirect anode secondary products may be prepared using the improved methods of the invention. For example, the monoesters di-, tri- and tetra-(2-hydroxyethyl)esters, as well as polyesters, in general, by oxidation of appropriate alkyl substituted aromatics, such as di-, tri- and tetra-alkylated benzenes and naphthalenes and reaction of these products with ethylene glycol; ethers from reactions of ethylene glycol and indirectly generated benzylic alcohols derived from milder alkylaromatic oxidation; dioxolanes by reaction of ethylene glycol and indirectly generated aldehydes and ketones derived from oxidation of primary and secondary alcohols.

A still further embodiment of the invention is the dehydration of purified ethylene glycol to diethylene glycol, triethylene glycol or higher polyether analogues and subsequent reaction with secondary products formed by indirect electrolysis, such as polybasic acids capable of forming polyesters as previously described. Similarly, dehydration of ethylene glycol over certain catalysts, like aluminum oxide, is known to yield acetaldehyde, which may be further condensed, hydrogenated or reacted to provide alcohols, such as ethanol, 1,3-butanediol, pentaerythritol and amines like diethylamine and pyridine derivatives. These products may then be reacted accordingly with the appropriate secondary products from indirect electrolysis to yield valuable compounds.

The expression "organic substrate" is also intended to include ethylene glycol formed in the catholyte which can also be reacted by indirect electrolysis. Thus, a further embodiment of the invention also includes paired electro-chemical synthesis with the preparation of ethylene glycol in which products are derived from the oxidation of ethylene glycol itself. Depending on the reaction conditions and particularly the choice of regeneratable redox reagent, ethylene glycol may be oxidized to oxalic acid, glyoxylic acid, hydroxyacetic acid, glycolaldehyde or glyoxal. If oxalic acid (OA) is the desired coproduct, the overall process with ethylene glycol may be represented by the equation:

$$8CH_2O + 2H_2O \rightarrow 3EG + OA \quad (VIII)$$

The mole ratio of EG to OA is 3:1. Likewise for production of glyoxal (GO) the theoretical mole ratio of EG to GO is 1:1.

The following specific examples demonstrate the various embodiments of the invention, however, it is to be understood that these examples are for illustrative purposes only and do not purport to be wholly definitive as to conditions and scope.

EXAMPLE I

Part A

Paired electrochemical synthesis process is conducted in an anion exchange membrane-containing cell in which ethylene glycol is produced on the cathode side. $Ce^{+4}$ oxidant produced on the anode side of the cell is used to oxidize an organic substrate outside the cell in an indirect process, and the recovered spent $Ce^{+3}$ containing solution is returned to the cell for regeneration.

In conducting the process, a two compartment glass cell is employed with catholyte and anolyte volumes of 100 mL each, separated by a fluorinated Tosoh TSK TM anion exchange membrane. The catholyte consists of 1.0 molar sodium methanesulfonate in 100 mL of 37 percent formalin containing 1 percent by weight tetramethylammonium hydroxide, adjusted and maintained at a pH of 6.5 to 7.0 by additions of methanesulfonic acid, while the anolyte consists of 0.75 molar cerium carbonate dissolved in 100 mL of 4 molar aqueous methanesulfonic acid. The cathode is a graphite rod and the anode is platinum. During electrolysis the cell temperature is maintained at about 70° C. by means of a heating bath while both cell compartments are magnetically stirred. Passage of 10,000 coulombs of direct current is achieved by means of a DC power supply in which the cathodic and anodic current density is 100 $mA/cm^2$. Ethylene glycol is formed in the catholyte and $Ce^{+4}$ methanesulfonate in the anolyte. After electrolysis, the anolyte is withdrawn into a separate reactor and vigorously stirred with a solution of naphthalene in ethylene dichloride until the chemical reaction has been completed. Naphthoquinone is isolated and the spent aqueous $Ce^{+3}$ methanesulfonate is returned to the electrochemical cell for regeneration of the $Ce^{+4}$ oxidant.

Part B

In a similar experiment to that of Part A, sodium formate is used in place of sodium methanesulfonate. The catholyte pH is maintained by the addition of formic acid in the electrolytic production of ethylene glycol at high current efficiency. Simultaneously, the current efficiency for anodic regeneration of $Ce^{+4}$ from $Ce^{+3}$ is very low. This demonstrates the necessity of using an oxidation stable electrolyte, like methanesulfonate with a two compartment anion exchange membrane separated cell.

Part C

Under conditions of continuous operation, in a flow cell system, the organic reaction products are separated as in Part A above, and a portion of the spent aqueous $Ce^{+3}$ solution is returned to the cell for regeneration to the $C^{+4}$ oxidation state. The remaining portion is partially distilled in a continuous manner, under vacuum to recover excess methanesulfonic acid which is reused for maintaining the catholyte pH at about 6.5 to 7.0. The undistilled liquid containing the $Ce^{+3}$ redox ions is filtered and fed back to the anolyte stream for regeneration, and to maintain the total cerium ion concentration at about 0.75 molar.

EXAMPLE II

A paired electrochemical synthesis reaction is conducted using a stable cation exchange membrane in which transfer of positively charged redox species into the catholyte is inhibited by maintaining a high anolyte proton concentration compared to redox species.

A two compartment flow cell system (MP Flow Cell, manufactured by Electrocell, Sweden) is equipped with a Union Carbide ATJ TM graphite cathode, $PbO_2$ on titanium anode, DuPont Nafion 117 membrane, pumps, flow meters, anolyte and catholyte reservoirs heated to 80° C., coulometer and DC power supply. The electrodes have 100 $cm^2$ of active surface area and the catholyte, maintained at a pH of about 6.5, consists of 1.0 molar sodium formate in 40 percent by weight aqueous formaldehyde containing less than 2 percent by weight methanol, 0.5 percent by weight tetrabutylammonium formate, and 0.5 percent by weight EDTA. The anolyte consists of a mixture of 0.5 molar $Cr^{+3}$, 0.5 molar $Cr^{+6}$ and 0.05 molar $Ce^{+3}$ in 3 molar aqueous sulfuric acid. Electrolysis is conducted at a current density of 150 $mA/cm^2$ and a flow rate of anolyte and catholyte of about 2.0 liters/minute. After passage of 400,000 coulombs of charge, electrolysis is discontinued, the ethylene glycol separated by extraction from the catholyte, and the oxidant transferred to a stirred reactor containing p-xylene where chemical reaction produces terephthalic acid. Spent, separated $Cr^{+3}$ is returned to the cell for regeneration in further experiments.

The purified ethylene glycol and terephthalic acid products are combined to esterify the terephthalic acid at 100° to 150° C. at 10–70 bar pressure in the presence of a copper catalyst. The intermediate, bis(2-hydroxymethyl) terephthalate is then polymerized at 150 to 270° C under vacuum in the presence of $Sb_2O_3$ catalyst to produce polyethylene terephthalate as a melt.

EXAMPLE III

A fluorinated bipolar membrane is constructed by sandwiching a DuPont Nafion 117 cation exchange membrane and a Tosoh TSK TM anion exchange membrane together using liquid Nafion resin (Aldrich Chemical Co.) as a "glue", while heating under pressure until a good bond is achieved. Employing the conditions of Example I, Part B, except for use of the bipolar membrane, ethylene glycol is formed in the catholyte and $Ce^{+4}$ methanesulfonate is formed in the anolyte with no cerium salt passing through the bipolar membrane into the catholyte.

EXAMPLE IV

The following demonstrates four configurations for operating a three compartment electrochemical cell for paired electrochemical synthesis according to the invention:

Part A

A three compartment MP flow cell system is set up with a 100 $cm^2$ Union Carbide ATJ graphite cathode and an Eltech TIR-2000 TM dimensionally stable anode, a DuPont Nafion 324 cation exchange membrane between the catholyte and central compartments and a Tosoh TSK anion exchange membrane between the central and anolyte compartments. The catholyte consists of 1.0 molar sodium methanesulfonate in 37 percent formalin with 1 percent by weight tetrabutylammonium methanesulfonate at a pH of 6.5. The anolyte consists of 0.5 molar $Ce^{+3}$ methanesulfonate in 5.0 molar aqueous methanesulfonic acid. The central compartment electrolyte consists of 5.0 molar aqueous methanesulfonic acid. Each electrolyte, consisting of 1 liter, is circulated continuously into the cell from heated reservoirs maintained at 90° C., while the cell current is maintained at 20 amps. A charge of 400,000 coulombs is passed, generating ethylene glycol in the catholyte, and $Ce^{+4}$ oxidant in the anolyte which is used for further reaction outside of the cell with naphthalene to produce naphthoquinone, and the spent $Ce^{+3}$ redox species is returned to the cell for regeneration.

In continuous operation, excess methanesulfonic acid is recovered (see Example I, Part C) by distillation of the spent $Ce^{+3}$ solution and this more concentrated methanesulfonic acid distillate is added, as required, to the central compartment to maintain the concentration of methanesulfonic acid therein, while the $Ce^{+3}$ solution in the "pot" is returned to the anolyte for regeneration.

Part B

In a manner similar to Part A of this Example, the three compartment flow cell is set up with an RAI Raipore 4035 anion exchange membrane on the catholyte side and a DuPont Nafion 417 cation exchange membrane on the anolyte side of the central compartment, which contains aqueous methanesulfonic acid. Under continuous operation, excess methanesulfonic acid accumulating in the central compartment is recovered by diverting a side stream, passing this through an ion exchange resin bed or electrolysis cell to remove any $Ce^{+3}$ and $Ce^{+4}$ contaminant salts, and then utilizing this purified methane-sulfonic acid solution to maintain the catholyte pH. This mode of operation possesses an important advantage over Part A of this Example in that a much less costly anion exchange membrane is not in contact with oxidizing $Ce^{+4}$ ions Part C In a manner similar to Part A of this Example, a three compartment flow cell is set up with an RAI Raipore 4035 anion exchange membrane on the catholyte side and a Tosoh TSK anion exchange membrane on the anolyte side of the central compartment which contains aqueous methanesulfonic acid. Under continuous operation, excess methanesulfonic acid is recovered from the spent anolyte stream containing $Ce^{+3}$ ion by means of distillation, and is utilized for maintaining the pH of the catholyte. This manner of operation utilizes a combination of less costly and more costly anion exchange membranes, and is not as desirable on a capital cost basis as the arrangement in Part B of this Example.

Part D

In a manner similar to Part A of this Example the three compartment flow cell is set up with two DuPont Nafion 417 membranes containing the central compartment electrolyte comprising aqueous sulfuric acid. In continuous operation, the central compartment electrolyte is continuously purified to remove contaminating $Ce^{+3}$ and $Ce^{+4}$ ions as well as any neutral organic substances like formaldehyde and ethylene glycol by passing of this electrolyte through an electrolysis cell followed by treatment with activated carbon.

While the invention has been described in conjunction with specific examples thereof, they are illustrative only. Accordingly, many alternatives, modifications and variations will be apparent to those skilled in the art in light of the foregoing descriptions, and it is therefore intended to embrace all such alternatives, modifications and variations as to fall within the spirit and broad scope of the appended claims.

We claim:

1. A method of conducting a paired electrochemical synthesis reaction which comprises the steps of:

(a) in a membrane divided electrochemical cell comprising an anode in an anolyte compartment and a cathode in a catholyte compartment, reducing electrochemically a formaldehyde containing catholyte to form ethylene glycol;

(b) providing a regeneratable redox reagent containing anolyte having higher and lower valence state ions;

(c) electrochemically oxidizing the lower valence state ions of said regeneratable redox reagent at the anode to the higher valence oxidizing state while simultaneously forming ethylene glycol at the cathode of the same electrochemical cell at an ethylene glycol current efficiency of at least 70 percent;

(d) chemically reacting the anolyte comprising the higher valence state ions of said regeneratable redox reagent with an oxidizable organic substrate to produce an organic compound and spent redox reagent, and (e) anodically regenerating the spent redox reagent.

2. The method of claim 1 wherein the chemical reaction between said higher valence oxidizing state ions of the regeneratable redox reagent and said organic substrate is conducted in a reaction zone outside the electrochemical cell, said method including the step of separating said organic compound from the spent redox reagent before returning said spent redox reagent to the anolyte compartment for regeneration.

3. The method of claim 2 wherein said regeneratable redox reagent having higher and lower valence state ions is selected from the group consisting of $Cr_2O_7^{-2}/Cr^{+3}$, $Ce^{+4}/Ce^{+3}$, $Co^{+3}/Co^{+2}$, $Ru^{+6}/Ru^{+4}$, $Mn^{+3}/Mn^{+2}$, $Fe^{+3}/Fe^{+2}$, $Pb^{+4}/Pb^{+2}$, $VO_2^{+}/VO^{+2}$, $Ag^{+2}/Ag^{+}$, $Tl^{+3}/Tl^{+}$ and mixtures thereof

4. The method of claim 2 wherein the regeneratable redox reagent having higher and lower valence state ions is a member selected from the group consisting of $Cr_2O_7^{-2}/Cr^{+3}$, $Ce^{+4}/Ce^{+3}$, $Co^{+3}/Co^{+2}$ and $Ru^{+6}/Ru^{+4}$.

5. The method of claim 2 wherein the electrochemical cell is equipped with a stable cation exchange membrane.

6. The method of claim 5 wherein the stable cation exchange membrane is a fluorinated ion exchange membrane.

7. The method of claim 5 wherein the regeneratable redox reagent is $Cr_2O_7^{+3}$ and the molar concentration of the $Cr_2O_7^{-2}$ ion in the anolyte is at least equivalent to that of the $Cr^{+3}$ ion.

8. The method of claim 5 including the step of adding to the anolyte sufficient strong acid to inhibit passage of the regeneratable redox reagent from the anolyte to the catholyte compartments.

9. The method of claim 8 wherein the ratio of the molar hydrogen ion concentration of said strong acid in the anolyte compartment is greater than the total molar concentration of positively charged ions of said regeneratable redox reagent.

10. The method of claim 8 wherein the pH of the anolyte comprising said strong acid solution is less than about 1.

11. The method of claim 5 wherein the catholyte includes a metal ion complexing agent.

12. The method of claim 11 wherein the metal ion complexing agent is selected from the group consisting of EDTA and NTA.

13. The method of claim 2 wherein the membrane divided electrochemical cell is a three compartment cell comprising a central compartment positioned between anolyte and catholyte compartments.

14. The method of claim 13 wherein at least one membrane of the said three compartment cell is a stable fluorinated anion exchange membrane.

15. The method of claim 13 wherein both membranes of said three compartment cell are stable cation exchange membranes, and the anolyte side membrane is fluorinated.

16. The method of claim 13 wherein both membranes of said three compartment cell are stable anion exchange membranes, and the anolyte side membrane is fluorinated.

17. The method of claim 2 wherein the electrochemical cell is equipped with a stable anion exchange membrane, a catholyte containing the salt of an acid with an oxidation stable anion, and includes an oxidation stable acid added to the catholyte to maintain the pH of the catholyte in the range from about 5 to about 8.

18. The method of claim 17 wherein the anion of the oxidation stable acid is a member selected from the group consisting of sulfate, bisulfate, phosphate, methanesulfonate, fluoride, tetrafluoroborate and hexafluorophosphate.

19. The method of claim 17 wherein oxidation stable acid accumulating in the anolyte is recovered and recycled to the catholyte.

20. The method of claim 17 wherein the stable anion exchange membrane is a fluorinated type.

21. The method of claim 2 wherein the membrane of the electrochemical cell is a stable bipolar type.

22. The method of claim 21 wherein the stable bipolar membrane is a fluorinated type.

23. The method of claim 2 wherein the higher valence state oxidizing ion of said regeneratable redox reagent is reacted with an oxidizable aromatic compound.

24. The method of claim 23 wherein the oxidizable aromatic compound is benzene, naphthalene or anthracene and the product formed is the corresponding quinone.

25. The method of claim 23 wherein the oxidizable aromatic compound is p-xylene, p-toluic acid, p-hydroxymethyl toluene, p-hydroxymethylbenzaldehyde or 1,4-dihydroxymethylbenzene and the product formed is terephthalic acid.

26. The method of claim 25 including the step of condensing the terephthalic acid with ethylene glycol produced from the catholyte of the electrochemical cell to form polyethylene terephthalate.

27. The method of claim 23 wherein the oxidizable aromatic compound is m-xylene which is oxidized to isophthalic acid, and the isophthalic acid is condensed with ethylene glycol produced from the catholyte of the electro-chemical cell to form polyethylene isophthalate.

28. A method of making polyesters in a paired electro-chemical synthesis reaction, which comprises the steps of:

(a) reducing in a membrane divided electrochemical cell a formaldehyde-containing catholyte to form ethylene glycol;

(b) oxidizing simultaneously in the same electrochemical cell a regeneratable redox reagent-containing anolyte to form ions having a higher valence oxidizing state;

(c) chemically reacting said higher valence state ions of said regeneratable redox reagent in a reaction zone outside said electrochemical cell with an organic compound which is suitable for forming a polybasic acid;

(d) separating spent regeneratable redox reagent from said polybasic acid and anodically regenerating said spent reagent, and (e) condensing the ethylene glycol produced from the catholyte with said polybasic acid to form a polyester.

29. The method of claim 28 wherein the polybasic acid formed is a member selected from the group consisting of terephthalic acid, isophthalic acid, trimesic acid, naphthalene-1,4-dicarboxylic acid and an aliphatic acid of the formula $HOOC\text{-}(CH_2)_n\text{-}COOH$ wherein n is a number from 2 to 10.

30. The method of claim 29 wherein the polyester formed is polyethylene terephthalate or polyethylene isophthalate.

* * * * *